US012426733B2

(12) United States Patent
Capizzi

(10) Patent No.: US 12,426,733 B2
(45) Date of Patent: Sep. 30, 2025

(54) DRINKING CUP WITH ICE RETAINER

(71) Applicant: Gregory Capizzi, Point Pleasant, NJ (US)

(72) Inventor: Gregory Capizzi, Point Pleasant, NJ (US)

( * ) Notice: Subject to any disclaimer, the term of this patent is extended or adjusted under 35 U.S.C. 154(b) by 0 days.

(21) Appl. No.: 18/507,539

(22) Filed: Nov. 13, 2023

(65) Prior Publication Data

US 2024/0081562 A1 Mar. 14, 2024

Related U.S. Application Data

(62) Division of application No. 17/852,522, filed on Jun. 29, 2022, now Pat. No. 11,832,744.

(51) Int. Cl.
*A47G 19/22* (2006.01)

(52) U.S. Cl.
CPC ..... *A47G 19/2216* (2013.01)

(58) Field of Classification Search
CPC ..... A47G 19/2211; A47G 19/2266; A47G 19/12; A47G 19/2288; A47G 19/2216; B65D 3/24; B65D 25/2897; B65D 1/42; B65D 1/44
USPC .... 220/254.3, 703, 720, 675, 669–671, 731, 220/711–719, 704
See application file for complete search history.

(56) References Cited

U.S. PATENT DOCUMENTS 2,357,063 A 8/1944 Swing
2,459,558 A 1/1949 Villegas De Oribe
3,150,084 A * 9/1964 Rodges ..... A47G 19/2211 210/474
4,020,532 A 5/1977 Lichter
D315,478 S 3/1991 Liggens
D315,479 S 3/1991 Liggens
5,702,024 A 12/1997 Riso
5,727,712 A 3/1998 Costello
5,803,316 A 9/1998 Couture
5,853,106 A 12/1998 Galluzzo
5,860,558 A * 1/1999 Fahy ..... A47G 19/2272 220/731
5,971,202 A 10/1999 Filbrun
8,113,378 B2 2/2012 Linnenbaum
8,474,641 B2 7/2013 Hays et al.
9,320,374 B2 4/2016 Phipps
11,185,178 B1 11/2021 Nobari
2006/0091142 A1* 5/2006 Topalian ..... B65D 1/265 220/675
2008/0000921 A1* 1/2008 Leon ..... B65D 43/0204 220/713

(Continued)

FOREIGN PATENT DOCUMENTS

FR 3094881 A1 4/2019

*Primary Examiner* — Nathan J Jenness
*Assistant Examiner* — Madison L Poos
(74) *Attorney, Agent, or Firm* — Greenberg Traurig, LLP

(57) ABSTRACT

A drinking cup assembly including a drinking cup configured to retain a liquid within an interior of the drinking cup; and a retainer configured to retain ice within the interior of the drinking cup while permitting the liquid to flow from the interior of the drinking cup, where the drinking cup includes a grip portion, where the grip portion has a retainer attachment section, where the retainer includes a cup attachment section, where the retainer attachment section is disposed within the cup attachment section.

16 Claims, 14 Drawing Sheets

(56) References Cited

U.S. PATENT DOCUMENTS

| | | | | |
|---|---|---|---|---|
| 2008/0054005 | A1* | 3/2008 | Cai | B65D 43/0212<br>220/711 |
| 2008/0202150 | A1 | 8/2008 | Siordia | |
| 2011/0240664 | A1 | 10/2011 | Liggens | |
| 2012/0267378 | A1* | 10/2012 | Hays | A47G 19/2288<br>220/592.17 |

* cited by examiner

DRINKING CUP WITH ICE RETAINER

CROSS-REFERENCE TO RELATED APPLICATION

The present application is a divisional of U.S. patent application Ser. No. 17/852,522, filed Jun. 29, 2022, entitled DRINKING CUP WITH ICE RETAINER, the entire contents of which are incorporated herein by reference.

FIELD OF THE APPLICATION

The application relates to a drinking cup, and, more specifically, to a drinking cup including a retainer configured to retain ice or an ice-substitute, for example, within the drinking cup, while configured to permit a liquid within the drinking cup to flow out of the drinking cup.

BACKGROUND

Often, a person intending to drink from a drinking cup will add ice or an ice-substitute (such as a closed, sealed container filled with frozen water or another substance) as well as a liquid to the drinking cup, so that the ice or ice-substitute cools the liquid.

When the person tips the drinking cup which includes the ice or an ice-substitute to drink the liquid in the drinking cup, often the ice or ice-substitute is carried with the liquid to the opening of the cup. As a result, the ice or ice-substitute may impact the mouth, lips, chin, or other portion of the person's face while the person is drinking the liquid from the drinking cup.

SUMMARY

In an embodiment, a drinking cup assembly comprises a drinking cup configured to retain a liquid within an interior of the drinking cup; and a retainer configured to retain ice within the interior of the drinking cup while permitting the liquid to flow from the interior of the drinking cup, wherein the drinking cup comprises a grip portion, wherein the grip portion comprises a retainer attachment section, wherein the retainer comprises a cup attachment section, wherein the retainer attachment section is disposed within the cup attachment section.

In an embodiment, a connection between the retainer attachment section and the cup attachment section comprises an interference fit.

In an embodiment, the connection further comprises a weld.

In an embodiment, the connection further comprises an adhesive connection.

In an embodiment, a connection between the retainer attachment section and the cup attachment section comprises an adhesive connection.

In an embodiment, a connection between the retainer attachment section and the cup attachment section comprises a weld.

In an embodiment, the retainer attachment section comprises a substantially flat surface with at least one of a depression and a protrusion.

In an embodiment, the cup attachment section comprises at least one of a depression and a protrusion, configured to cooperatively attach to the at least one of the depression and the protrusion of the retainer attachment section.

In an embodiment, the retainer includes a plurality of openings configured to permit the liquid to flow through the openings and configured to retain the ice in the drinking cup.

In an embodiment, the retainer includes a plurality of openings configured to permit the liquid to flow through the openings and configured to retain the ice in the drinking cup.

In an embodiment, the retainer is configured to be temporarily attached to the drinking cup.

In an embodiment, the retainer is configured to be permanently attached to the drinking cup.

In an embodiment, the cup attachment section and the retainer attachment section are configured to cooperatively attach to one another.

In an embodiment, the retainer is configured to fold between a first position and a second position.

In an embodiment, the retainer is configured to fold between a first position where the retainer is against a wall of the drinking cup, and a second position, where the retainer is out of contact with the wall of the drinking cup.

In an embodiment, the retainer is biased toward the second position.

In an embodiment, the retainer includes at least one opening configured to permit the liquid to flow through the at least one opening and retain the ice in the drinking cup.

In an embodiment, the at least one opening comprises a plurality of openings.

In an embodiment, the grip portion comprises at least one of a protrusion and a recess.

In an embodiment, the retainer is configured to be removable from the drinking cup.

DETAILED DESCRIPTION

Figure 1:
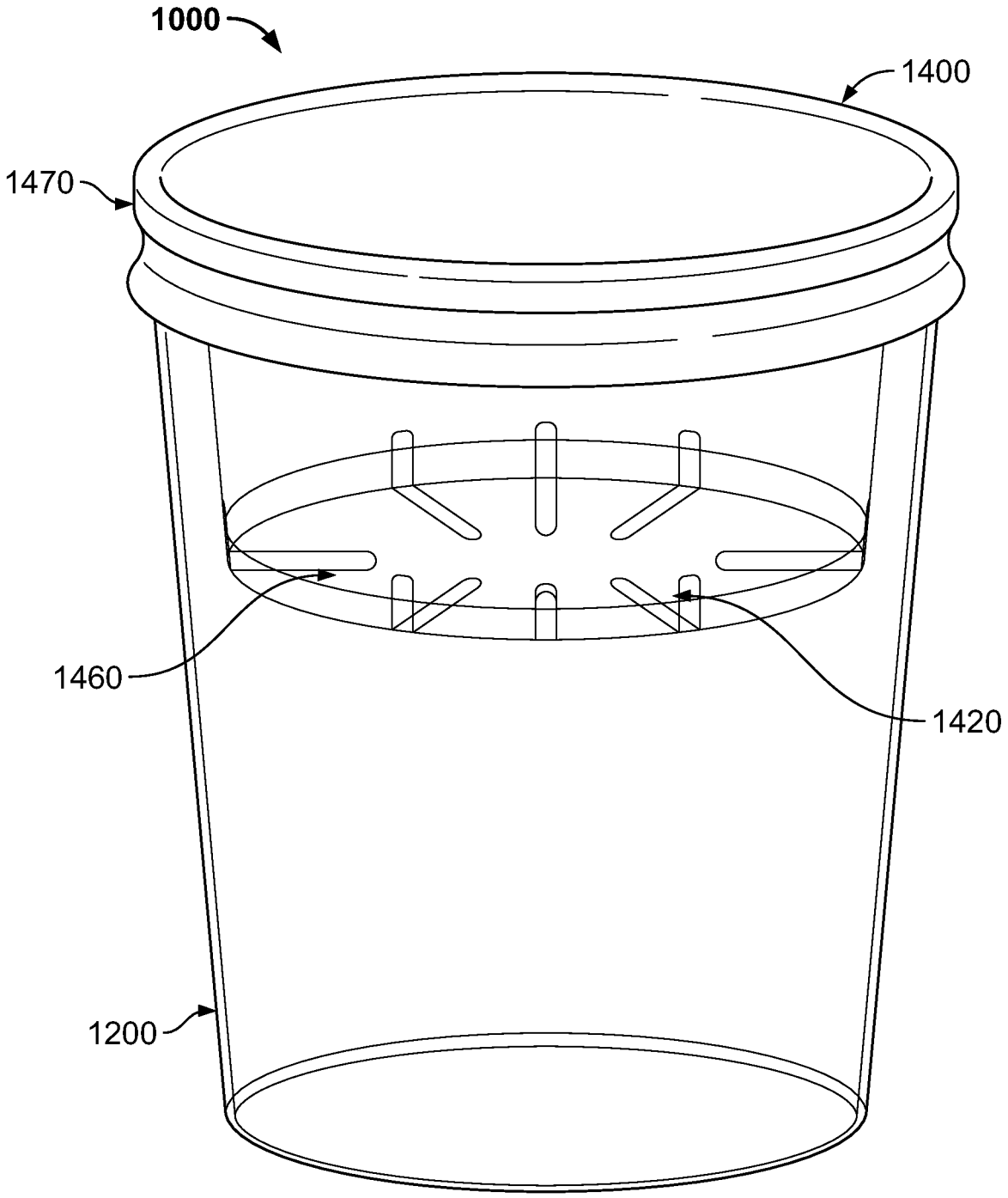
FIG. 1 is an isometric view of a first embodiment of a drinking cup assembly.
Figure 2:
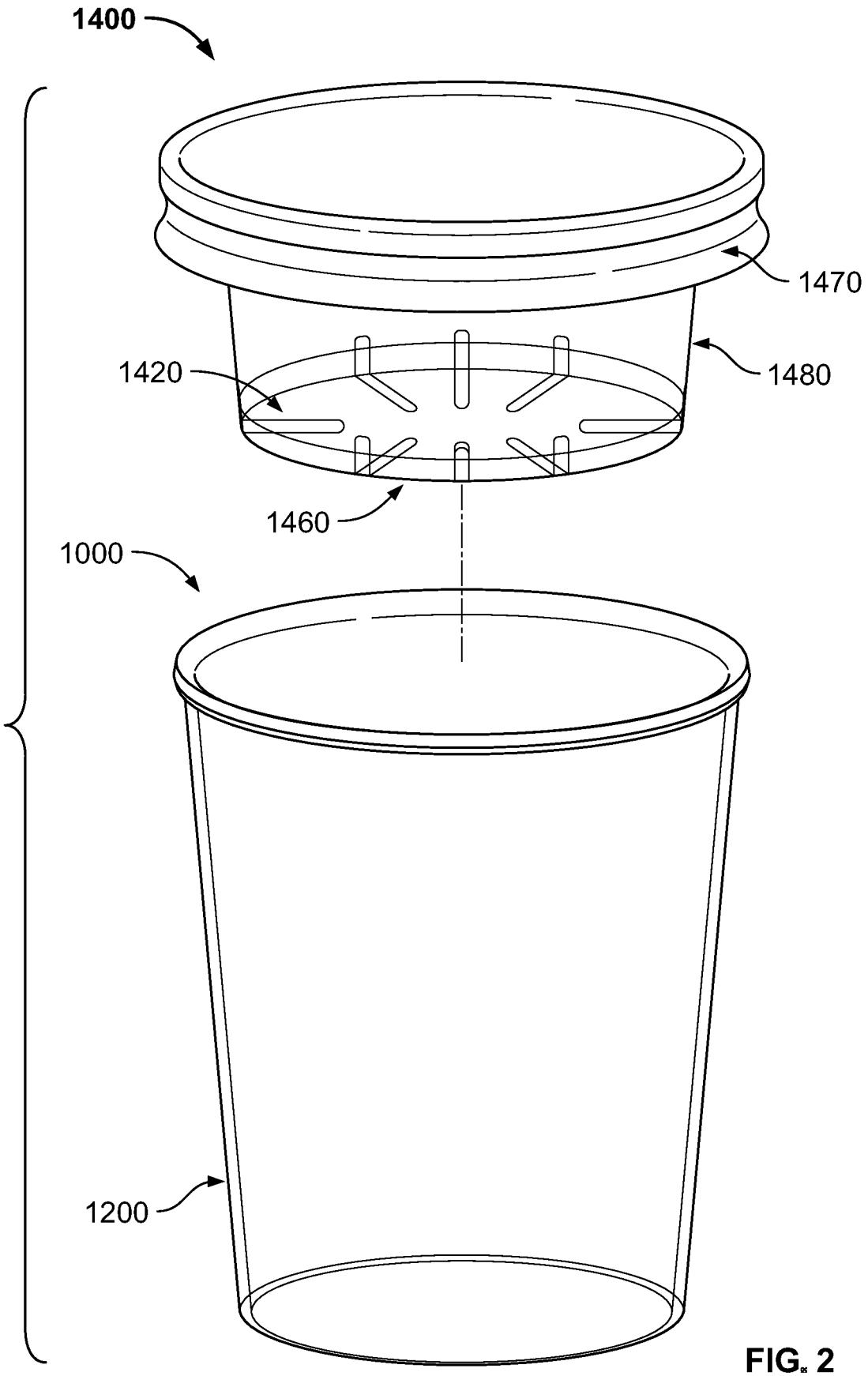
FIG. 2 is an exploded isometric view of the first embodiment of FIG. 1.
Figure 3:
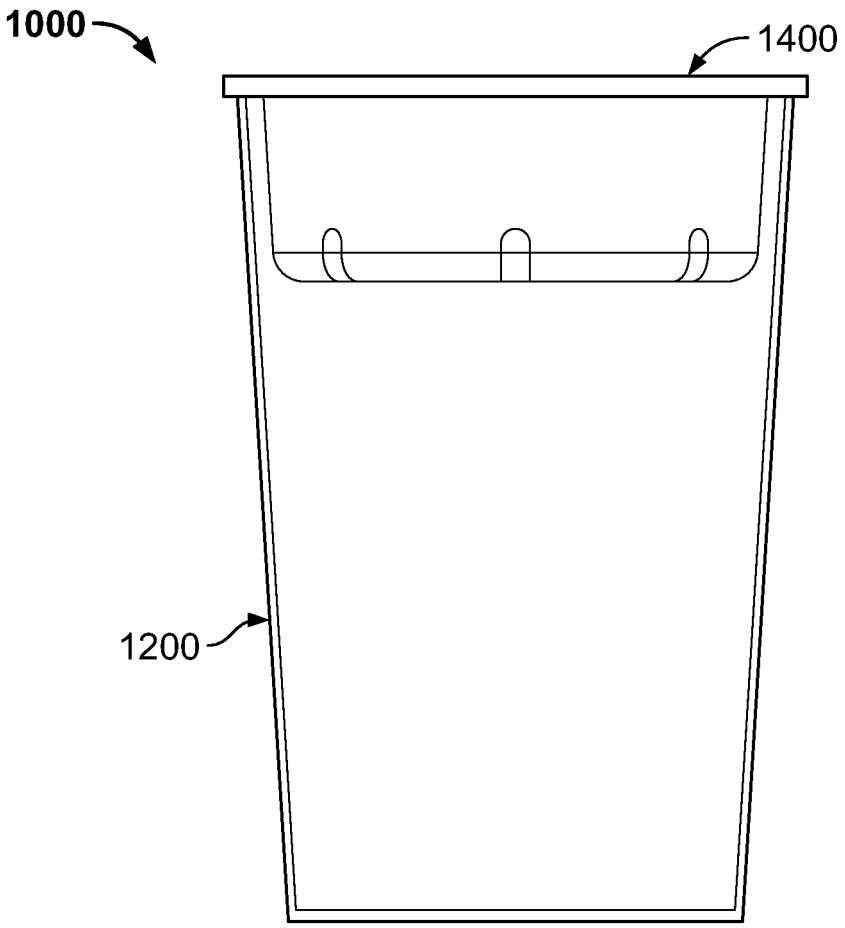
FIG. 3 is a side view of the first embodiment of FIG. 1.
Figure 4:
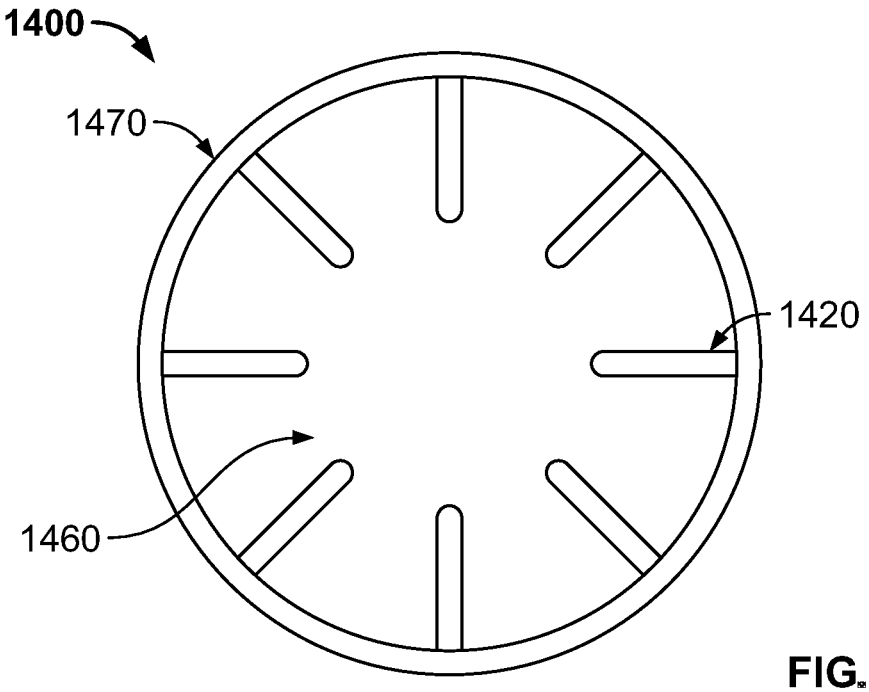
FIG. 4 is a top view of the retainer of the first embodiment of FIG. 1.
Figure 5:
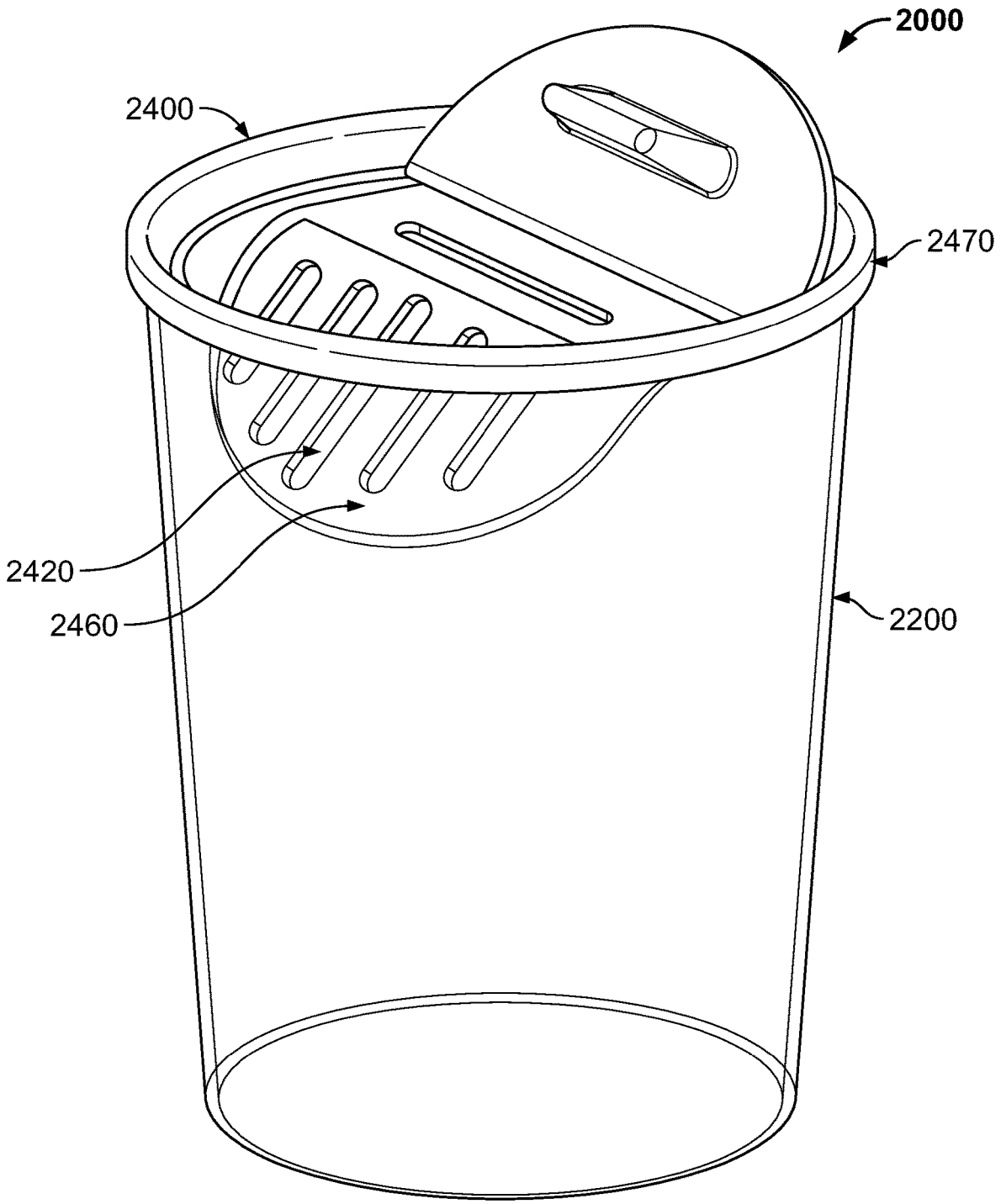
FIG. 5 is an isometric view of a second embodiment of the drinking cup assembly.
Figure 6:
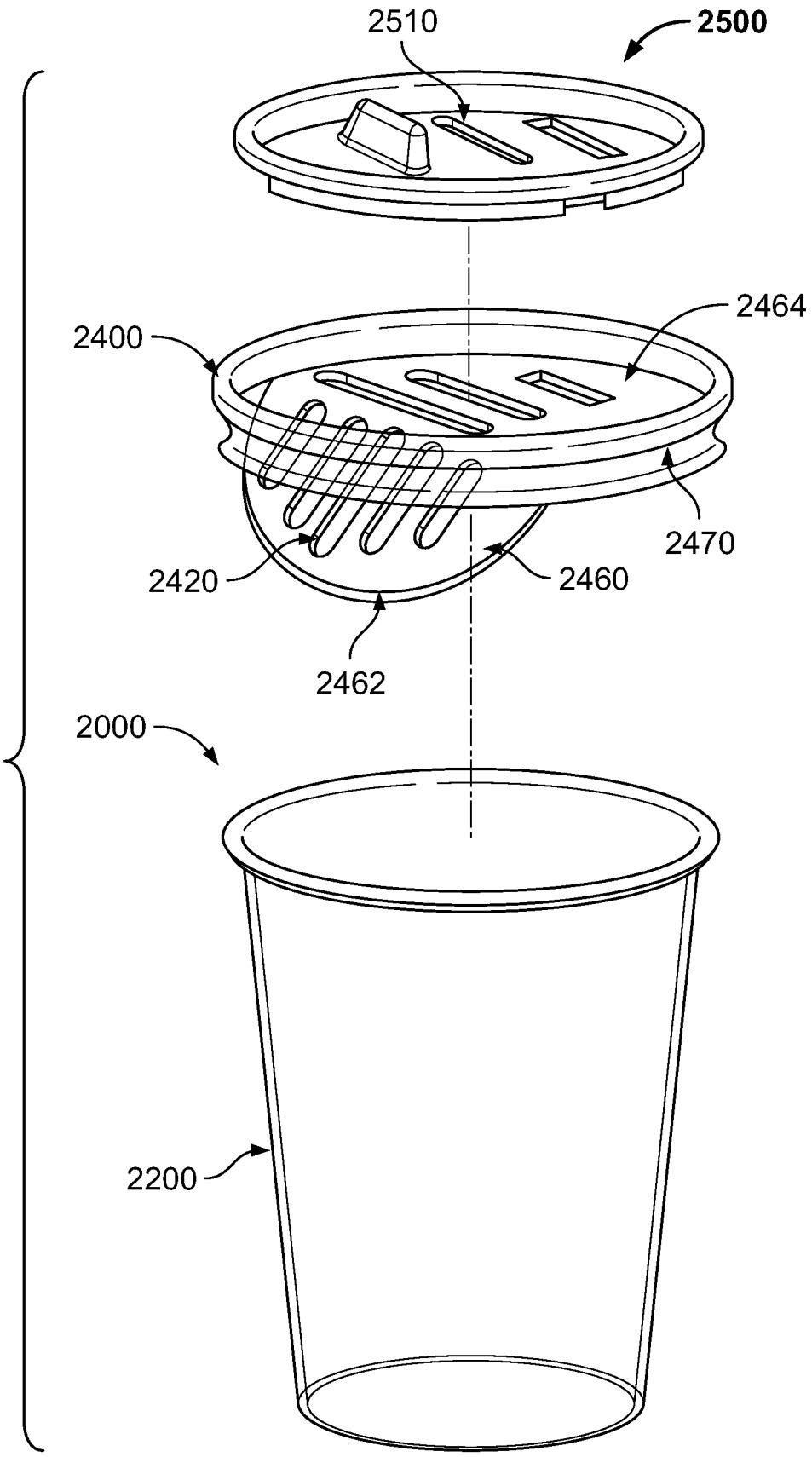
FIG. 6 is an exploded isometric view of the second embodiment of FIG. 5.
Figure 7:
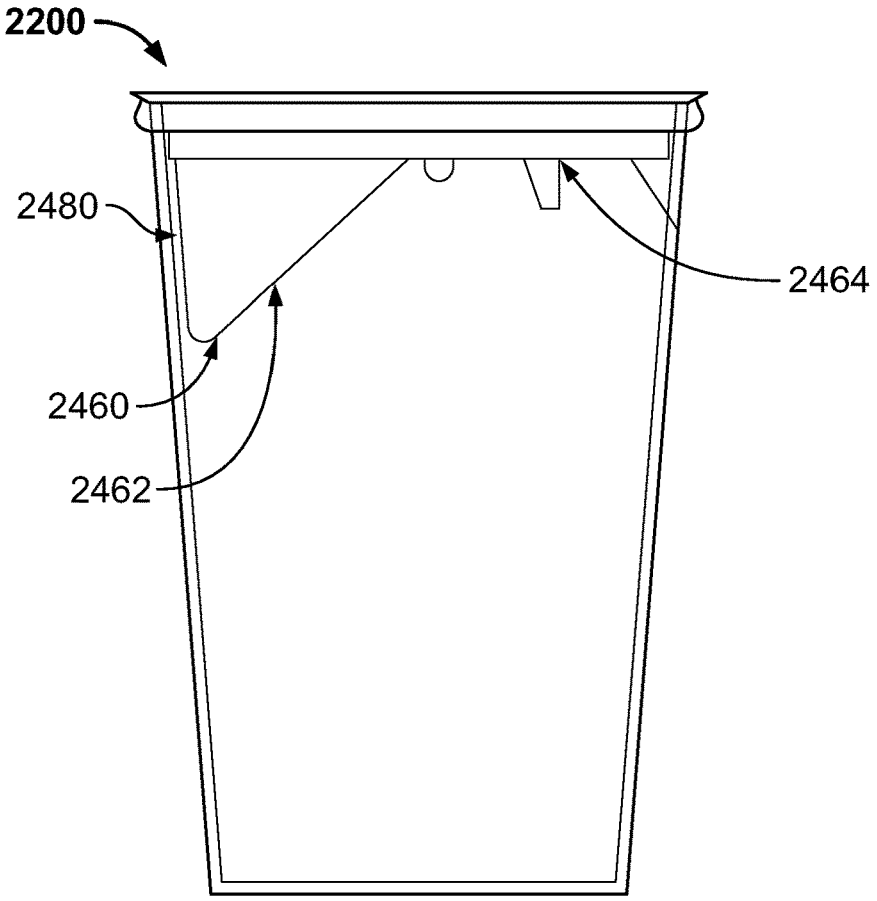
FIG. 7 is a side view of the second embodiment of FIG. 5.
Figure 8:
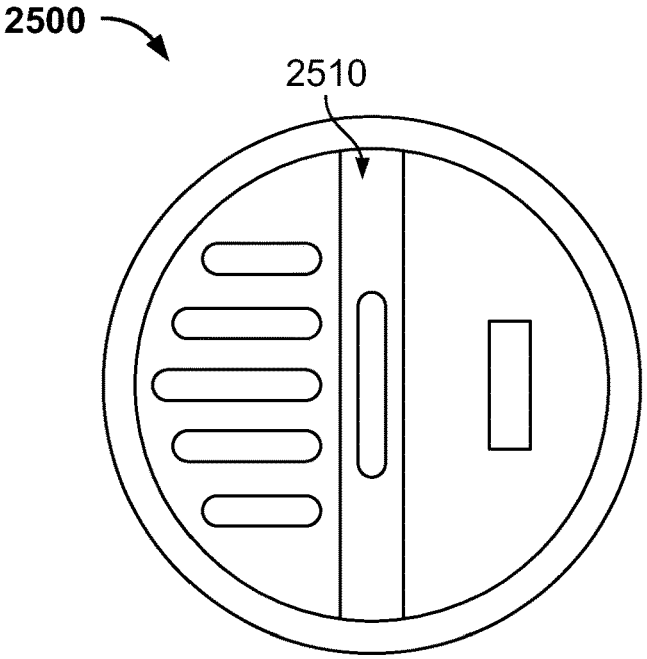
FIG. 8 is a top view of the retainer and lid of the second embodiment of FIG. 5.

FIGS. 1-4 illustrate a first embodiment of the drinking cup assembly. As shown in the figures, drinking cup assembly 1000 includes drinking cup 1200 and retainer 1400. Drinking cup 1200 may be configured to hold a liquid, such as a beverage, which a person intends to drink. The figures show a liquid and ice in drinking cup 1200.

Drinking cup 1200 may be formed from any material capable of holding the liquid. For example, the material of drinking cup 1200 may be one or more of: plastic, glass, metal such as steel or aluminum, bamboo, wheat, corn, paper, waxed paper, sugarcane, and/or any other material. Drinking cup 1200 may or may not be one or more of: disposable or non-disposable, recyclable or non-recyclable, compostable or non-compostable, or biodegradable or non-biodegradable. Drinking cup 1200 may be provided with, or may be provided separate from, retainer 1400. Drinking cup 1200 may be any of clear, translucent, or opaque. Drinking cup 1200 may be sized and shaped to hold any desired quantity of liquid.

Retainer 1400 may be formed from any material capable of retaining, to at least some degree, any solid, semi-solid, non-liquid, or semi-liquid within drinking cup 1200, while permitting another solid, semi-solid, non-liquid, or semi-liquid of or below a predetermined size, or permitting the liquid, within drinking cup 1200, to flow out of drinking cup 1200, such as when a person tips drinking cup 1200 intending to drink the liquid disposed therein. By way of example, retainer 1400 may retain within drinking cup 1200 one or more of: ice, an ice-substitute, a fruit, a vegetable, or any other object, while permitting the user to drink the liquid within drinking cup 1200. Retainer 1400 may be any of clear, translucent, or opaque.

Retainer 1400 may include one or more openings 1420 sized, shaped, oriented, and/or disposed to permit the liquid in drinking cup 1200 to flow through retainer 1400, while preventing, to at least some degree, an object (such as the ice or the ice-substitute) within the liquid from flowing through retainer 1400 and/or out of drinking cup 1200.

Retainer 1400 may include any number of openings 1420, such as, for example, one, two, three, four, five, six, seven, eight, or more opening 1420. As shown in the figures, retainer 1400 includes eight openings 1420. Openings 1420 may be formed anywhere within or on retainer 1400. For example, openings 1420 may be formed around an outer circumference of bottom surface 1460 of retainer 1400. Bottom surface 1460 may be any shape, such as substantially flat or dome-shaped, for example. Some or all openings 1420 may be the same size as, or different sizes than, one or more openings 1420. Openings 1420 may be any shape, including but not limited to slots, circles, arcs, or polygons, or any other shape. Openings 1420 may be distributed equally on bottom surface 1460 of retainer 1400, or may be distributed unequally on bottom surface 1460 of retainer 1400. As shown in the figures, openings 1420 are slots of substantially the same size, distributed equally on bottom surface 1460.

Retainer 1400 may include attachment section 1470, configured to attach retainer 1400 to an upper edge of drinking cup 1200. Attachment section 1470 may be sized, shaped, located, or otherwise disposed to permanently or temporarily attach retainer 1400 to drinking cup 1200. For example, attachment section 1470 may be sized, shaped, and/or made of an appropriate material, such that attachment section 1470 achieves a snap-fit (that is, an interference fit resulting from deformation of attachment section 1470) with the upper edge of drinking cup 1200.

For example, attachment section 1470 may permanently attach retainer 1400, which is intended to be disposable, to drinking cup 1200 that also is intended to be disposable. Attachment section 1470 may attach to any portion of a circumference of the upper edge of drinking cup 1200. For example, attachment section 1470 may attach to about 10%, 25%, 50%, 75%, 80%, 90%, 95%, 99%, or 100% of the circumference of the upper edge of drinking cup 1200. Attachment section 1470 may be connected to side wall 1480, which is connected to bottom surface 1460, of retainer 1400. Side wall 1480 may extend any percentage around the circumference of an inner wall or surface of drinking cup 1200. For example, side wall 1480 may extend about 10%, 25%, 50%, 75%, 80%, 90%, 95%, 99%, or 100% of the circumference of the inner wall or surface of drinking cup 1200. Openings 1420 may or may not be formed in at least some portion of side wall 1480.

A method of using drinking cup assembly 1000 may include filling drinking cup 1200 with ice or an ice-substitute, as well as a liquid. The method may include attaching attachment section 1470 of retainer 1400 to an upper edge of drinking cup 1200, before or after adding the ice, ice substitute, and/or liquid to drinking cup 1200, thereby to secure retainer 1400 to drinking cup 1200. Openings 1420 may be sized, shaped, oriented, and distributed to permit the liquid with drinking cup 1200 to pass through the openings 1420, while openings 1420 may prevent the ice or ice-substitute from passing through openings 1420, such as when the user tips drinking cup 1200 to drink the liquid within drinking cup 1200.

FIGS. 5-8 illustrate a second embodiment of the drinking cup assembly. As shown, drinking cup assembly 2000 includes drinking cup 2200 and retainer 2400. Drinking cup 2200, like all of the embodiments of drinking cups disclosed herein, may be similar to any other drinking cup described herein, such as drinking cup 1200. Retainer 2400, like all of the embodiments of retainers disclosed herein, may be similar to any other retainers described herein, such as retainer 1400, except to the extent that retainer 2400 is described below as differing from other retainers.

Retainer 2400 may include any number of openings 2420, such as, for example, one, two, three, four, five, or more opening 2420. As shown in the figures, retainer 2400 includes five openings 2420. Openings 2420 may be formed anywhere within or on retainer 2400, such as on bottom surface 2460. For example, openings 2420 may be formed around an outer circumference of bottom surface 2460 of retainer 2400. Openings 2420 may be the same size as, or different sizes than, one or more other openings 2420. Openings 2420 may be any shape, including but not limited to slots, circles, arcs, and polygons. Openings 2420 may be distributed equally on retainer 2400, or may be distributed unequally on retainer 2400. As shown in the figures, openings 2420 may include five slots, substantially parallel to one another.

Retainer 2400 may include attachment section 2470, configured to attach retainer 2400 to an upper edge of drinking cup 2200. Attachment section 2470 may be sized, shaped, or otherwise configured to permanently or temporarily attach retainer 2400 to drinking cup 2200. For example, attachment section 2470 may be sized, shaped, and/or made of an appropriate material, such that attachment section 2470 achieves a snap-fit with the upper edge of drinking cup 2200. For example, attachment section 2470 may permanently attach retainer 2400, which is intended to be disposable, to cup 2200 that also is intended to be disposable. Attachment section 2470 may attach to any portion of a circumference of the upper edge of drinking cup 2200. For example, attachment section 2470 may attach to about 10%, 25%, 50%, 75%, 80%, 90%, 95%, 99% or 100% of the circumference of the upper edge of drinking cup 2020. Attachment section 2470 may be connected to side wall 2480, which is connected to bottom surface 2460, of retainer 2400. Side wall 2480 may extend any percentage around the circumference of an inner wall or surface of drinking cup 2200. For example, side wall 2480 may extend about 10%, 25%, 50%, 75%, 80%, 90%, 95%, 99% or 100% of the circumference of the inner wall or surface of drinking cup 2200.

Attachment section 2470 may be connected to side wall 2480, which is connected to bottom surface 2460. Side wall 2480 may extend any percentage around the circumference of the inner wall or surface of drinking cup 2020. For example, side wall 2480 may extend about 10%, 25%, 50%, 75%, 80%, 90%, 95%, 99%, or 100% of the circumference of the inner wall or surface of drinking cup 2200. As shown in the figures, side wall 2480 extends 100% of the circumference of the inner wall or surface of drinking cup 2200.

Bottom surface 2460 may include first portion 2462 and second portion 2464, where first portion 2462 is relatively flat and disposed relatively horizontally, and second portion 2464 is relatively flat and disposed at an angle relative to first portion 2462. Either first portion 2462 and/or second portion 2464 may include openings 2420. For example, the drawings show second portion 2464 including openings 2420.

The second embodiment may optionally also include sealing lid 2500. Sealing lid 2500 may attach to either or both of the upper edge of cup 2200 and/or any portion or portions of retainer 2400. Sealing lid 2500 may include a hinge 2510, which permits at least a portion of sealing lid 2500 to be moved relative to another portion of sealing lid 2500, so that the user may open sealing lid 2500 without removing sealing lid 2500, to drink the liquid from drinking cup 2200.

A method of using drinking cup assembly 2000 may be similar to a method of using drinking cup assembly 1000. The method of using assembly 2000 may or may not include attaching or removing sealing lid 2500, and/or opening and closing sealing lid 2500.

Figure 9:
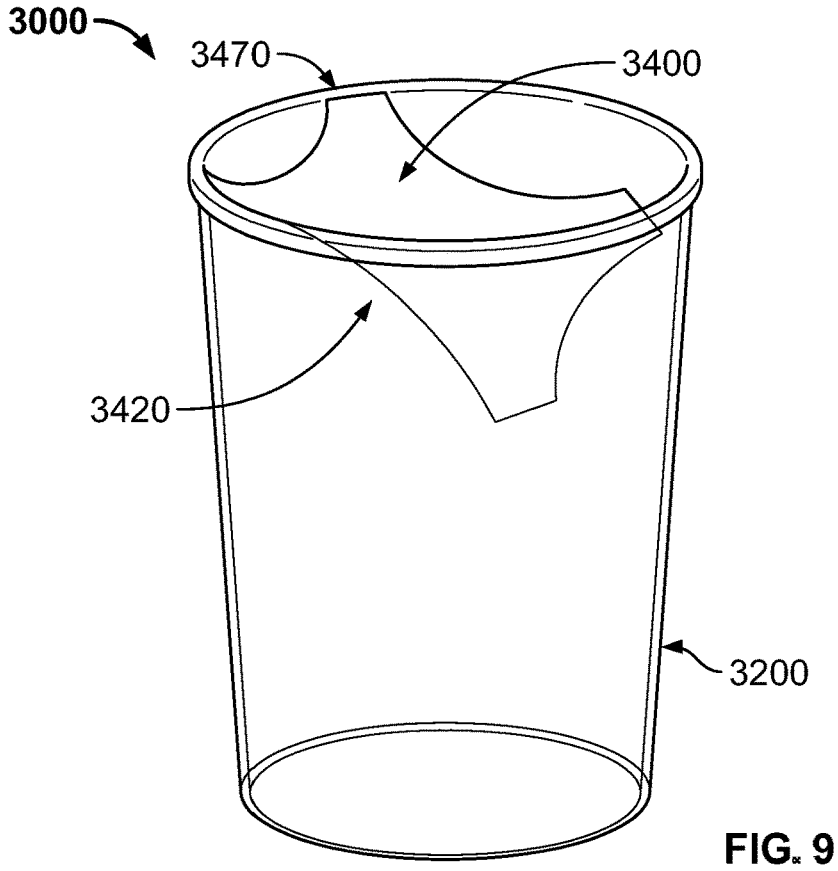
FIG. 9 is an isometric view of a third embodiment of the drinking cup assembly.
Figure 10:
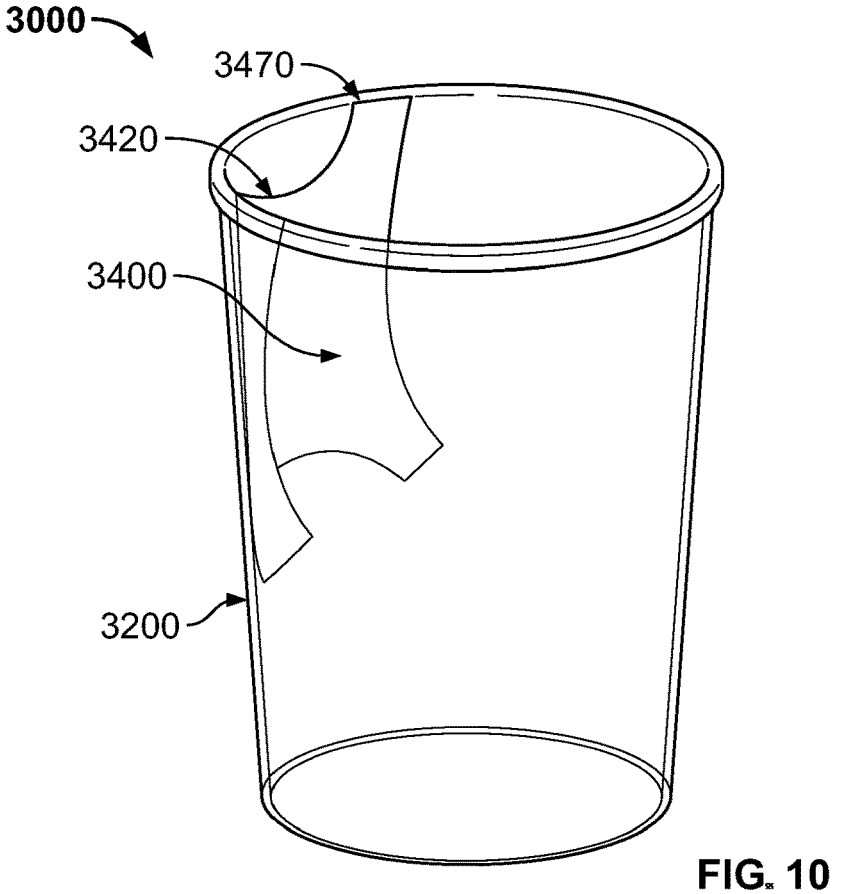
FIG. 10 is an isometric view of the third embodiment of FIG. 9.
Figure 11:
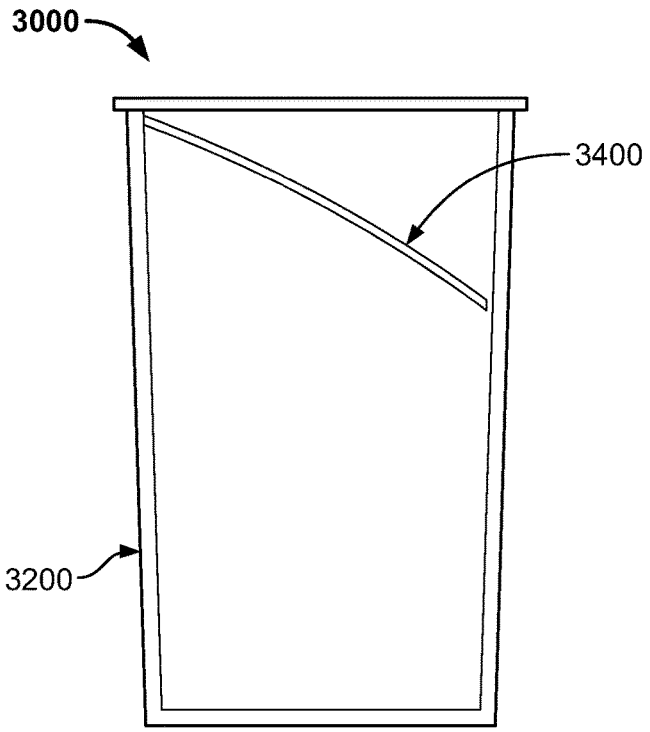
FIG. 11 is a side view of the third embodiment of FIG. 9.

FIGS. 9-11 illustrate a third embodiment of the drinking cup assembly. As shown, drinking assembly 3000 includes drinking cup 3200 and retainer 3400. Drinking cup 3200 may be similar to the other drinking cups described herein. Retainer 3400 may be similar to the other retainers, except to the extent that retainer 3400 is described below as differing from the other retainers.

Retainer 3400 may include any number of openings 3420, such as, for example, one, two, three, or four opening 3420. As shown in the figures, retainer 3400 includes four openings 3420. Openings 3420 may be formed anywhere within or on retainer 3400. For example, openings 3420 may be formed around an outer perimeter or circumference of retainer 3400. Openings 3420 may be the same size as, or different sizes than, one or more other openings 3420. Openings 3420 may be any shape, including but not limited to slots, circles, curves, and polygons. Openings 3420 may be distributed equally on the perimeter or circumference of retainer 3400, or may be distributed unequally on retainer 3400. As shown in the figures, openings 3420 may include four substantially-arcuate sections, formed on the outer circumference of an otherwise at least substantially circular retainer 3400.

Retainer 3400 may include attachment section 3470, configured to attach retainer 3400 to the upper edge of drinking cup 3200. Attachment section 3470 may be configured to permanently or temporarily attach retainer 3400 to drinking cup 3200. For example, attachment section 3470 may permanently attach retainer 3400, intended to be disposable, to drinking cup 3200, intended to be disposable. Attachment section 3470 may attach to any portion of a circumference of the upper edge of drinking cup 3200. For example, attachment section 3470 may attach to about 10%, 25%, 50%, 75%, 80%, 90%, 95%, 99%, or 100% of the circumference of the upper edge of drinking cup 3200. Attachment section 3700 may be connected to the upper edge of cup 3200, such as by welding, gluing, adhering, or sonically-welding attachment section 3470 to drinking cup 3200. Attachment section 3470 and/or retainer 3400 may be sized, shaped, disposed, and/or configured such that when retainer 3400 is in a folded-down configuration as shown in FIG. 10, a plurality of drinking cups 3200 may be nested (that is, stacked at least partially) inside one another, and after filling drinking cup 3200 with ice or an ice-substitute, for example, retainer 3400 may be positioned as shown in FIG. 9. Attachment section 3470 and retainer 3400 may, but need not, be formed at the same time drinking cup 3200 is formed, such as when drinking cup 3200 is formed by thermoform molding.

A method of using drinking cup assembly 3000 may be similar to other method of using drinking cups described herein. The method of using drinking cup assembly 3000 may include removing drinking cup 3200 from a stack of drinking cups, where retainer 3400 is disposed within and folded against a side wall of drinking cup 3200, folding retainer 3400 to a configuration in which retainer 3400 is disposed substantially outside of drinking cup 3020 (that is, folded up), filling drinking cup 3200 with ice or an ice-substitute, as well as a liquid (either before or after folding up retainer 3400), and folding retainer down to a configuration in which retainer 2030 may retain the ice within drinking cup 3020 (as shown in FIG. 11).

Figure 12:
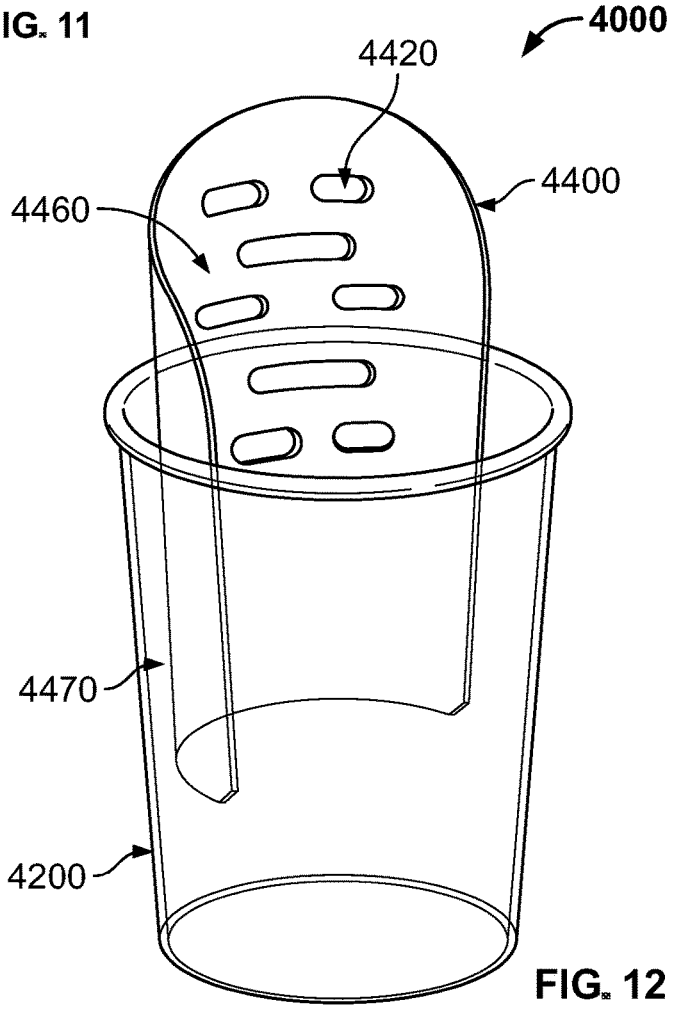
FIG. 12 is an isometric view of a fourth embodiment of the drinking cup assembly.
Figure 13:
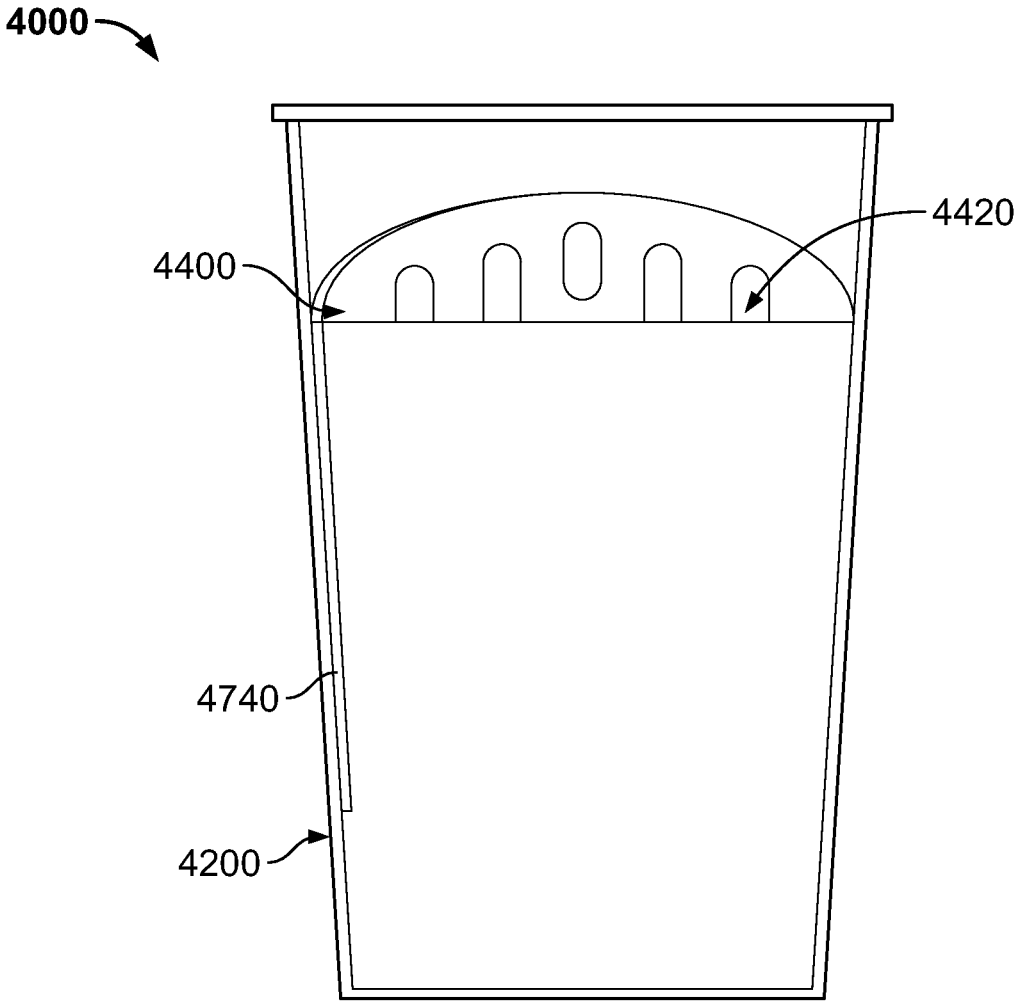
FIG. 13 is a side view of the fourth embodiment of FIG. 12.
Figure 14:
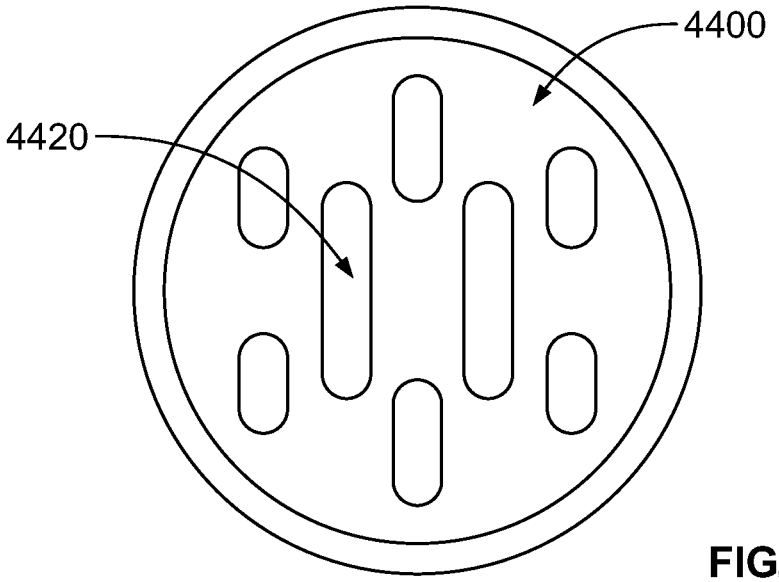
FIG. 14 is a top view of the fourth embodiment of FIG. 12.

FIGS. 12-14 illustrate a fourth embodiment of the drinking cup assembly. As shown, drinking cup assembly 4000 includes drinking cup 4200 and retainer 4400. Drinking cup 4200 may be similar to the other drinking cups described herein. Retainer 4400 may be similar to the other retainers, except to the extent that retainer 4400 is described below as differing from the other retainers.

Retainer 4400 may include any number of openings, such as, for example, one, two, three, four, five, six, seven, eight, or more opening 4420. As shown in the figures, retainer 4400 includes eight openings 4420. Openings 4420 may be formed anywhere within or on retainer 4400. For example, openings 4420 may be formed on bottom surface 4460 of retainer 4400. Openings 4420 may be the same size as, or different sizes than, one or more other openings 4420. Openings 4420 may be any shape, including but not limited to slots, circles, arcs, and polygons. Openings 4420 may be distributed equally on retainer 4400, or may be distributed unequally on retainer 4400. Openings 4420 may be the same size as, or different sizes than, one or more other openings 4420. Openings 4420 may be any shape, including but not limited to slots, circles, arcs, and polygons. Openings 4420 may be distributed equally on retainer 4400 or may be distributed unequally on retainer 4400. As shown in the figures, openings 4420 may be of various sizes.

Retainer 4400 may include attachment section 4470, configured to attach retainer 4400 to the inner surface of drinking cup 4200. Attachment section 4470 may be configured to permanently or temporarily attach retainer 4400 to drinking cup 4200. For example, attachment section 4470 may permanently attach retainer 4400, configured to be disposable, to drinking cup 4200, also configured to be disposable. Attachment section 4470 may be connected to the inner surface of cup 4200, such as by welding, adhering, gluing, or sonically-welding attachment section 4470 to cup 4200. Attachment section 4470 may be sized and shaped such that when attachment section 4470 and/or retainer 4400 are in a folded-up configuration, as shown in FIG. 12, a plurality of drinking cups 4200 may be nested inside one another. When in the folder-up configuration, retainer 4400 may be disposed above and outside of drinking cup 4200. When retainer 4400 is folded down to retain the ice in drinking cup 4200, that is, to be substantially horizontal (as shown in FIGS. 13 and 14), at least a portion of retainer 4400 may be any shape, such as substantially flat or a hyperbolic paraboloid shape (that is, saddle-shaped).

A method of using drinking cup assembly 4000 may be similar to other methods of using drinking cups described herein. A method of using drinking cup assembly 4000 may include removing drinking cup 4200 from a stack of drinking cups, where retainer 4400 is disposed substantially outside of drinking cup 4200 (as shown in FIG. 12), filling drinking cup 4200 with ice or an ice-substitute, as well as a liquid, and folding retainer 4400 to a configuration in which retainer 4400 may retain the ice within drinking cup 4020 (that is, folded down to be substantially saddle-shaped and disposed entirely within drinking cup 4200, as shown in FIG. 13).

FIGS. 15-18 illustrate a fifth embodiment of the drinking cup assembly. As shown, drinking cup assembly 5000 includes drinking cup 5200 and retainer 5400. Drinking cup 5200 may be similar to the other drinking cups described herein. Retainer 5400 may be similar to the other retainers, except to the extent that retainer 5400 is described below as differing from the other retainers.

Retainer 5400 may include two retainers 5400, about equally distributed about the opening of drinking cup 5200, and each retainer 5400 including any number of openings 5420, such as, for example, one, two, three, or more opening 5420. As shown in the figures, each retainer 5400 includes three openings 5420. Openings 5420 may be formed anywhere within or on retainer 5400. Openings 5420 may be the same size as, or different sizes than, one or more other openings 5420. Openings 5420 may be any shape, including but not limited to slots, circles, arcs, and polygons. Openings 5420 may be distributed equally on retainer 5400, or may be distributed unequally on retainer 5400. As shown in the figures, openings 420 may include three substantially parallel slots on each retainer 5400.

Figure 15:
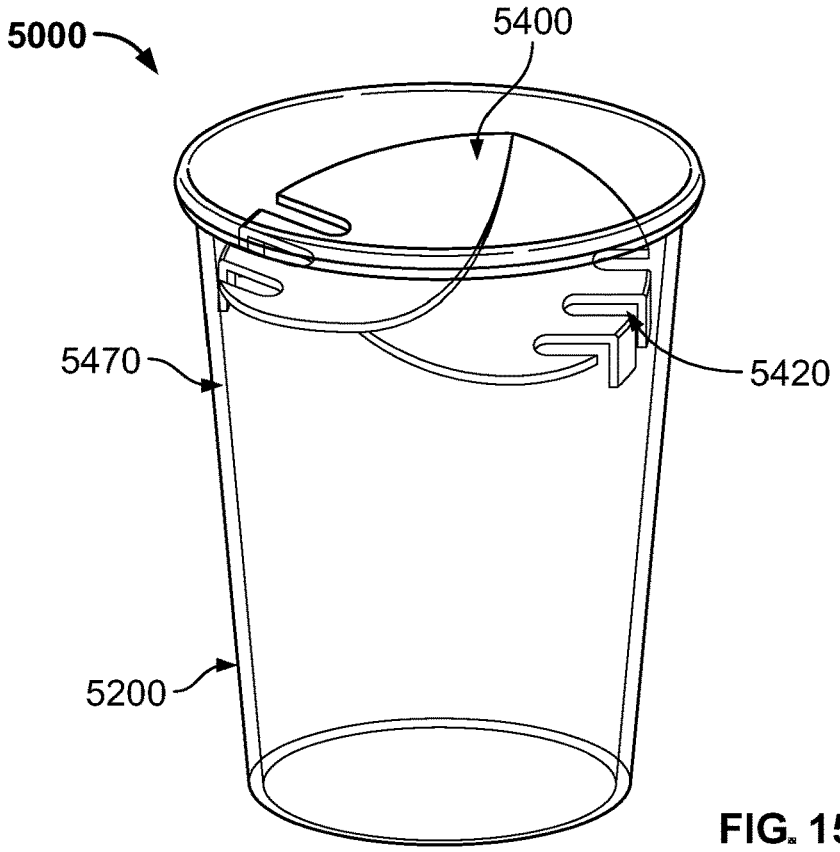
FIG. 15 is an isometric view of a fifth embodiment of the drinking cup assembly.
Figure 16:
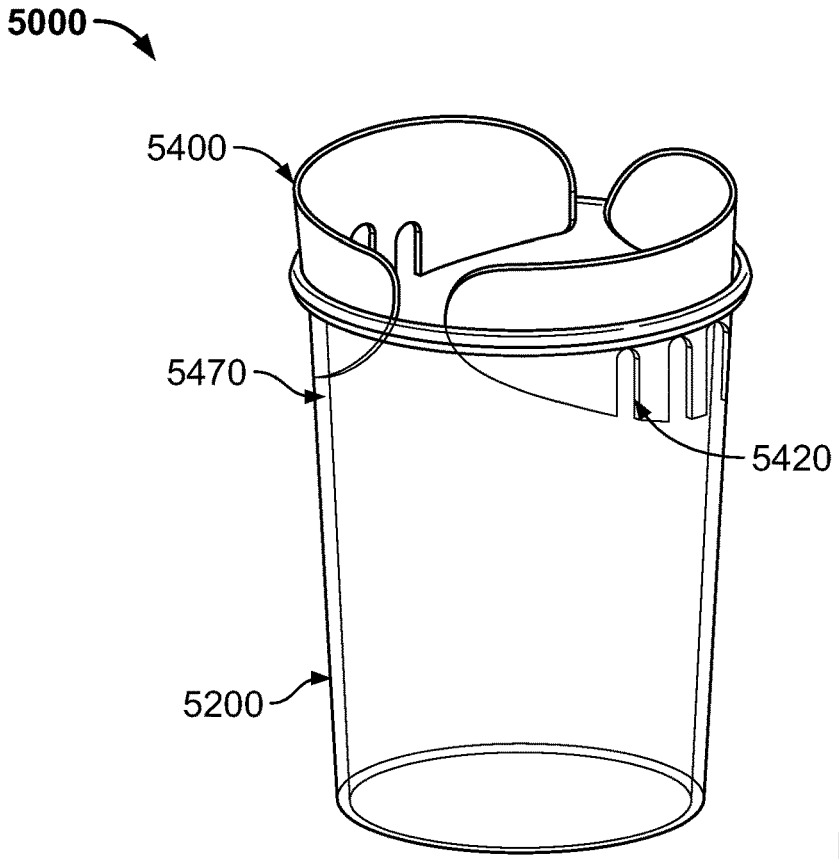
FIG. 16 is an isometric view of the fifth embodiment of FIG. 15.
Figure 17:
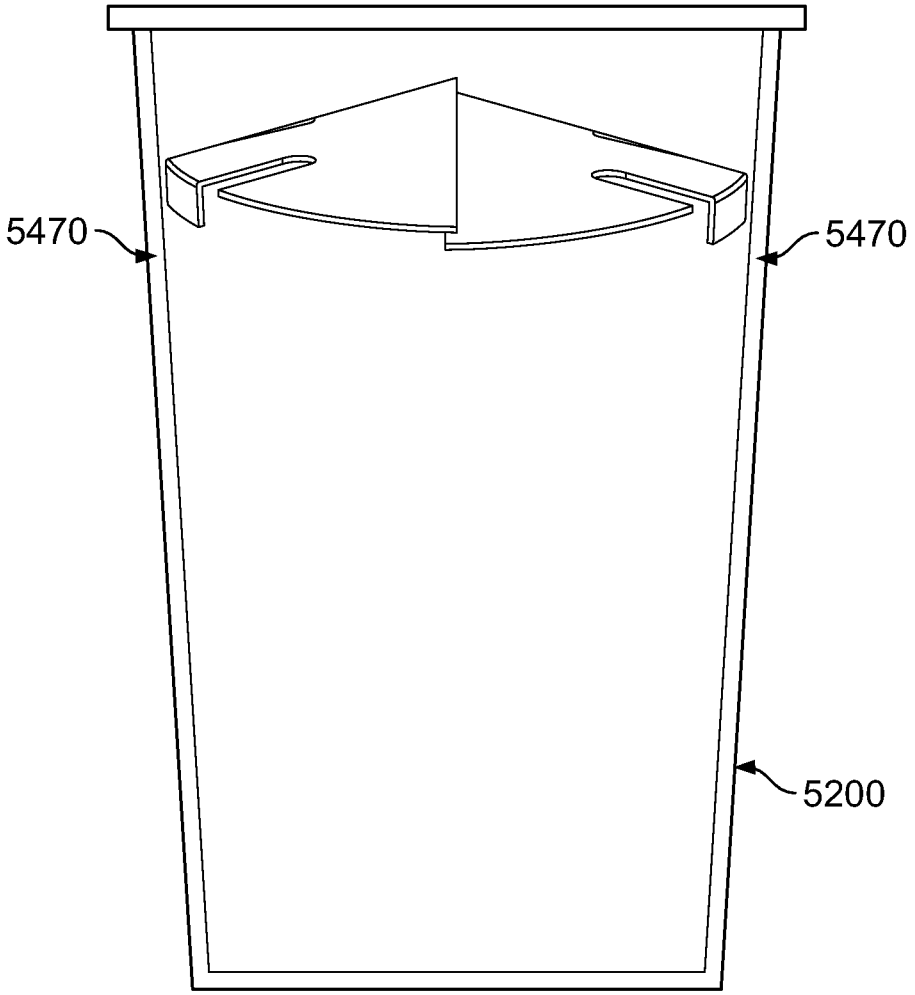
FIG. 17 is a side view of the fifth embodiment of FIG. 15.
Figure 18:
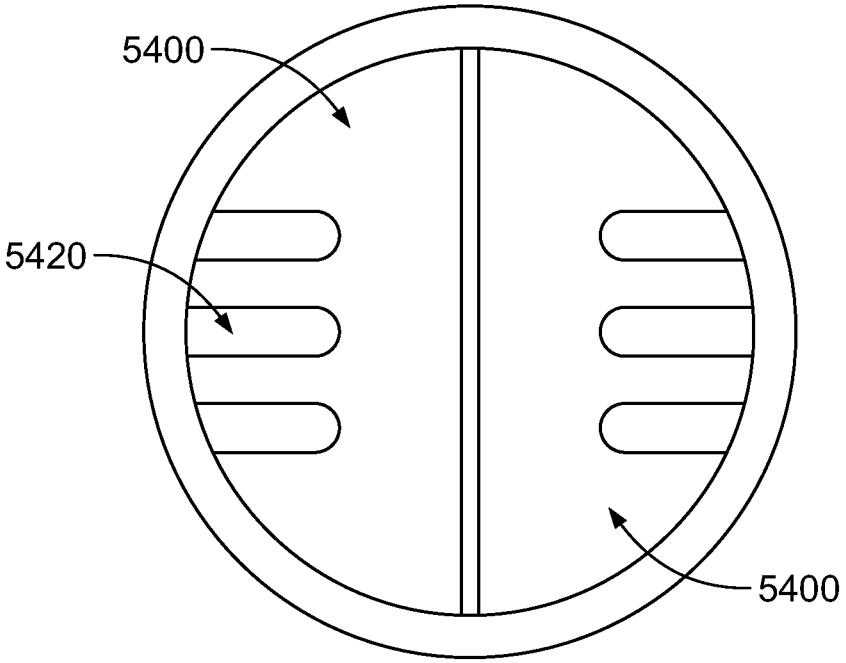
FIG. 18 is a top view of the retainer of the fifth embodiment of FIG. 15.

Each retainer 5400 may include attachment section 5470, configured to attach retainer 5400 to the inner surface of drinking cup 5200. Each attachment section 5470 may be configured to permanently or temporarily attach retainer 5400 to drinking cup 5200. For example, attachment section 5470 may permanently attach retainer 5400, configured to be disposable, to drinking cup 5200, also configured to be disposable. Attachment section 5470 may be connected to the inner surface of cup 5200, such as by welding, adhering, gluing, or sonically-welding attachment section 5470 to cup 5200. Alternatively, as shown in the figures, a single attachment section 5470 may attach both retainers 5400 to the inner wall or surface of drinking cup 5200. Attachment section 5470 may be sized and shaped such that when attachment section 5470 and/or retainer 5400 are in a folded-up configuration, as shown in FIG. 16, a plurality of drinking cups 5200 may be nested inside one another. When each retainer 5400 is folded down, as shown in FIG. 15, at least a portion of retainer 5400 may be any shape, such as flat, or a portion of a dome.

Each retainer 5400 may be disposed outside of and above the top surface of drinking cup 5200, when retainers 5400 are in the folded-up position, as shown in FIG. 16. Further, each retainer 5400 may be positionable within drinking cup 5200, so that retainers 5400 may be substantially horizontal when in the folded-down position.

A method of using drinking cup assembly 5000 may be similar to other methods of using drinking cups described herein. A method of using drinking cup assembly 5000 may include removing drinking cup 5200 from a stack of drinking cups where retainer 5400 is disposed substantially outside of drinking cup 5200 (FIG. 16), filling drinking cup 5200 with ice or an ice-substitute, as well as a liquid, and folding each retainer 5400 to a configuration in which retainer 5400 may retain the ice within drinking cup 5200—that is, from folded-up (FIG. 16), to folded-down (FIG. 15, FIG. 17), position.

Figure 19:
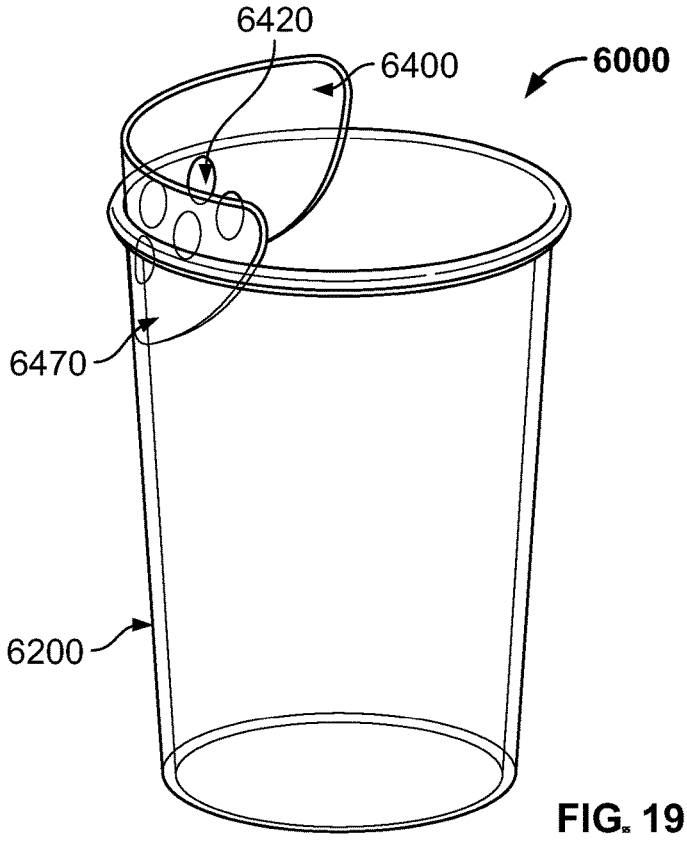
FIG. 19 is an isometric view of a sixth embodiment of the drinking cup assembly.
Figure 20:
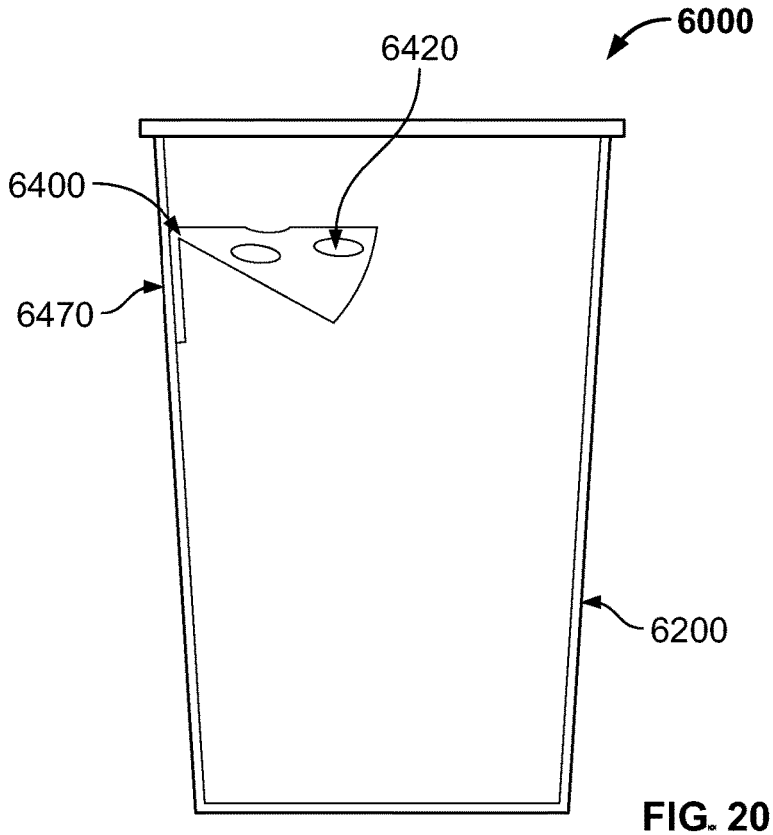
FIG. 20 is a side view of the sixth embodiment of FIG. 19

FIGS. 19-20 illustrate a sixth embodiment of the drinking cup assembly. As shown, drinking cup assembly 6000 includes drinking cup 6200 and retainer 6400. Drinking cup 6200 may be similar to the other drinking cups described herein. Retainer 6400 may be similar to the other retainers, except to the extent that retainer 6400 is described below as differing from the other retainers.

Retainer 6400 may include any number of openings—such as, for example, one, two, three, four, five, or more opening 6420. As shown in the figures, retainer 6400 includes five openings 6420. Openings 6420 may be formed anywhere within or on retainer 6400. Openings 6420 may be the same size as, or different sizes than, one or more other openings 6420. Openings 6420 may be any shape, including but not limited to slots, circles, arcs, and polygons. Openings 6420 may be distributed equally on retainer 6400, or may be distributed unequally on retainer 6400. As shown in the figures, openings 6420 may include five circles of various sizes.

Retainer 6400 may include attachment section 6470, configured to attach retainer 6400 to an inner surface of drinking cup 6200. Attachment section 6470 may be configured to permanently or temporarily attach retainer 6400 to drinking cup 6200. For example, attachment section 6470 may permanently attach retainer 6400, which is configured to be disposable, to drinking cup 6200, also configured to be disposable. Attachment section 6470 may be connected to the inner surface of drinking cup 6200, such as by welding, adhering, gluing, or sonically-welding attachment section 6470 to drinking cup 6200. Attachment section 6470 may be sized and shaped such that when attachment section 6470 and/or retainer 6400 are in a folded-up configuration, as shown in FIG. 19, a plurality of drinking cups 6200 may be nested inside one another. When retainer 6400 is folded down, as shown in FIG. 20, at least a portion of retainer 6400 may be any shape, such as flat, or a portion of a dome.

A method of using drinking cup assembly 6000 may be similar to other methods of using drinking cups described herein. A method of using drinking cup assembly 6000 may include removing drinking cup 6200 from a stack of drinking cups where retainer 6400 is disposed substantially outside of drinking cup 6200 (see FIG. 19), filling drinking cup 6200 with ice or an ice-substitute, as well as a liquid, and folding retainer 6400 from a configuration shown in FIG. 19 to a configuration in which retainer 6400 may retain the ice within drinking cup 6200 (that is, from folded up, to folded down), as shown in FIG. 20.

Figure 21:
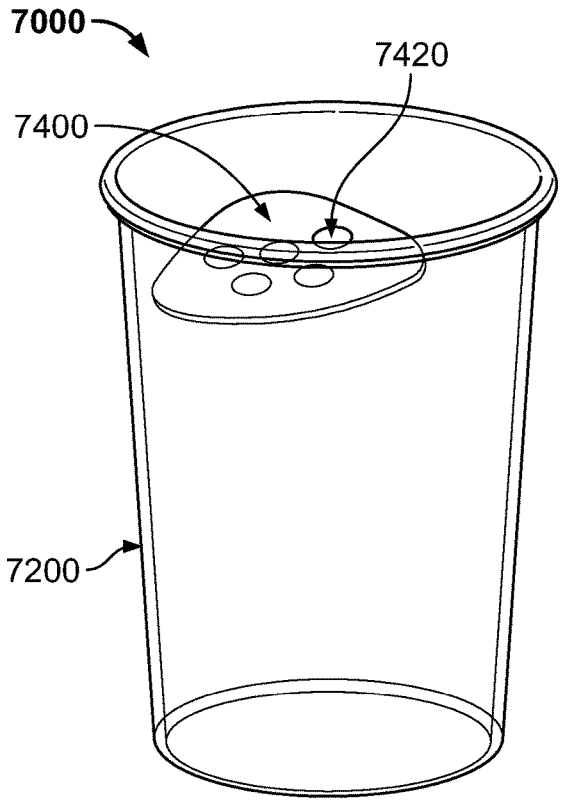
FIG. 21 is an isometric view of a seventh embodiment of the drinking cup assembly.
Figure 22:
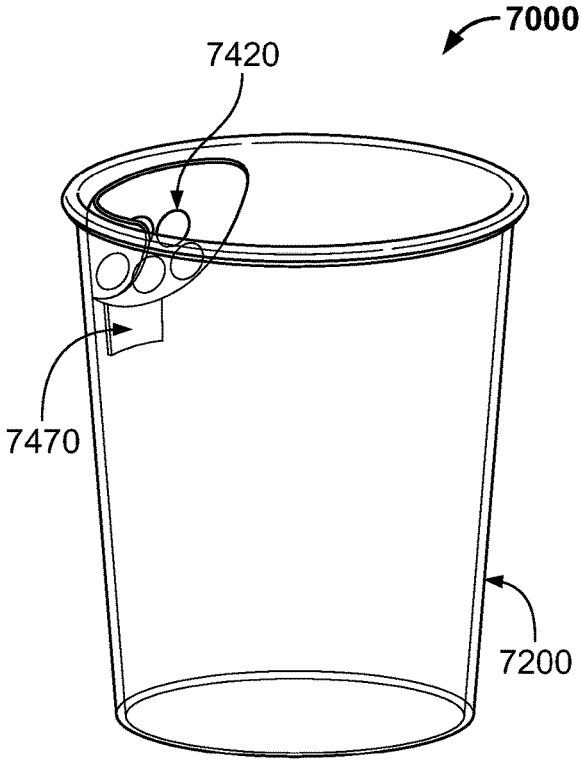
FIG. 22 is an isometric view of the seventh embodiment of FIG. 21.
Figure 23:
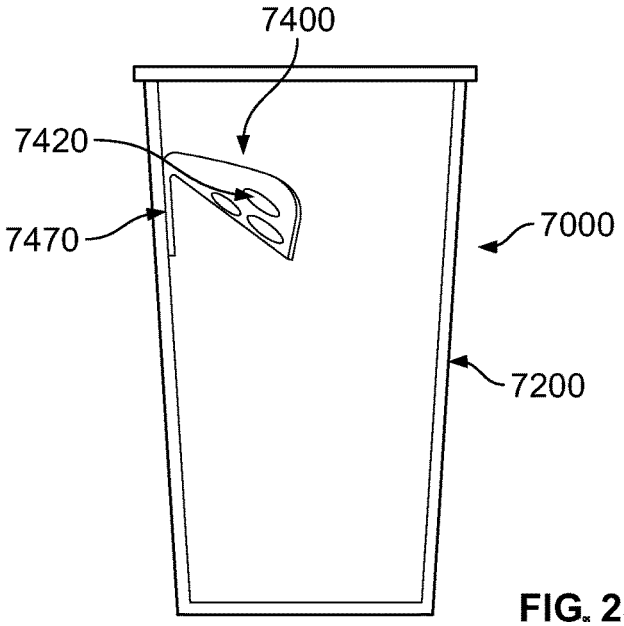
FIG. 23 is a side view of the seventh embodiment of FIG. 21.

FIGS. 21-23 illustrate a seventh embodiment of the drinking cup assembly. As shown, drinking cup assembly 7000 includes drinking cup 7200 and retainer 7400. Drinking cup 7200 may be similar to the other drinking cups described herein. Retainer 7400 may be similar to the other retainers, except to the extent that retainer 7400 is described below as differing from the other retainers.

Retainer 7400 may include any number of openings 7420, such as, for example, one, two, three, four, five, or more opening 7420. As shown in the figures, retainer 7400 includes five openings 7420. Openings 7420 may be formed anywhere within or on retainer 7400. Openings 7420 may be the same size as, or different sizes than, one or more other openings 7420. Openings 7420 may be any shape, including but not limited to slots, circles, arcs, and polygons. Openings 7420 may be distributed equally on retainer 7400, or may be distributed unequally on retainer 7400. As shown in the figures, openings 7420 may include five circles of various sizes.

Retainer 7400 may include attachment section 7470, configured to attach retainer 7400 to an inner surface of drinking cup 7200. Attachment section 7470 may be configured to permanently or temporarily attach retainer 7400 to drinking cup 7200. For example, attachment section 7470 may permanently attach retainer 7400, which is configured to be disposable, to drinking cup 7200, also configured to be disposable. Attachment section 7470 may be connected to the inner surface of drinking cup 7200, such as by welding, adhering, gluing, or sonically-welding attachment section 7470 to drinking cup 7200. Attachment section 7470 may be sized and shaped such that when attachment section 7470 and/or retainer 7400 are in a folded-up configuration, as shown in FIG. 22, a plurality of drinking cups 7200 may be nested inside one another. When in the folded-up configuration, retainer 7400 may be disposed entirely within drinking cup 7200. When retainer 7400 is folded down, as shown in FIG. 21 and FIG. 23, at least a portion of retainer 7400 may be any shape, such as flat, or a portion of a dome.

A method of using drinking cup assembly 7000 may be similar to other methods of using drinking cups described herein. A method of using drinking cup assembly 7000 may include removing drinking cup 7200 from a stack of drinking cups where retainer 7400 is folded up as shown in FIG. 22, filling drinking cup 7200 with ice and a liquid, and folding retainer 7400 to a configuration in which retainer 7400 may retain the ice within drinking cup 7200 (that is, from folded up, to folded down), as shown in FIG. 21.

Figure 24:
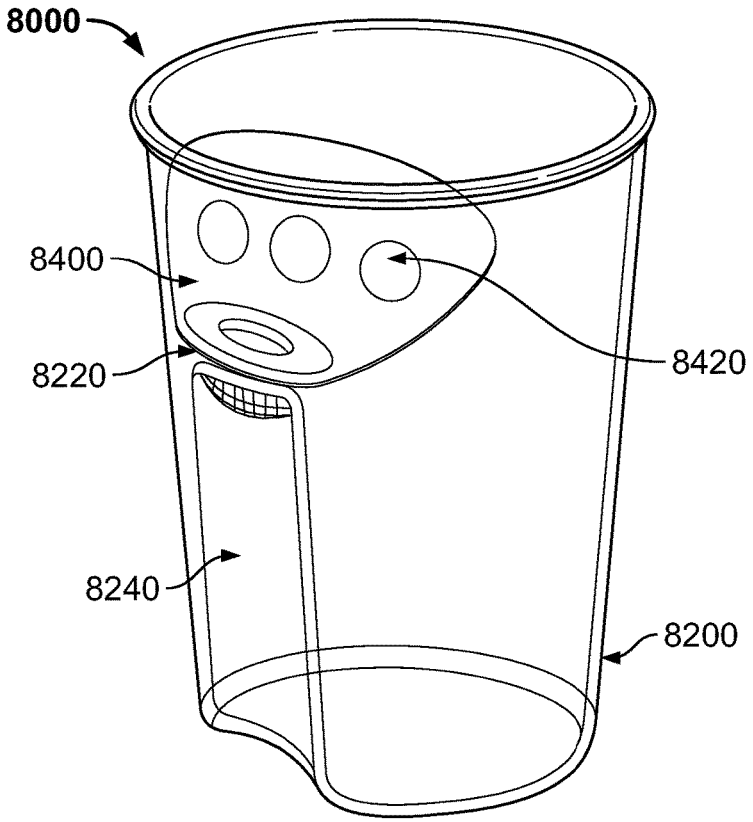
FIG. 24 is an isometric view of an eighth embodiment of the drinking cup assembly.
Figure 25:
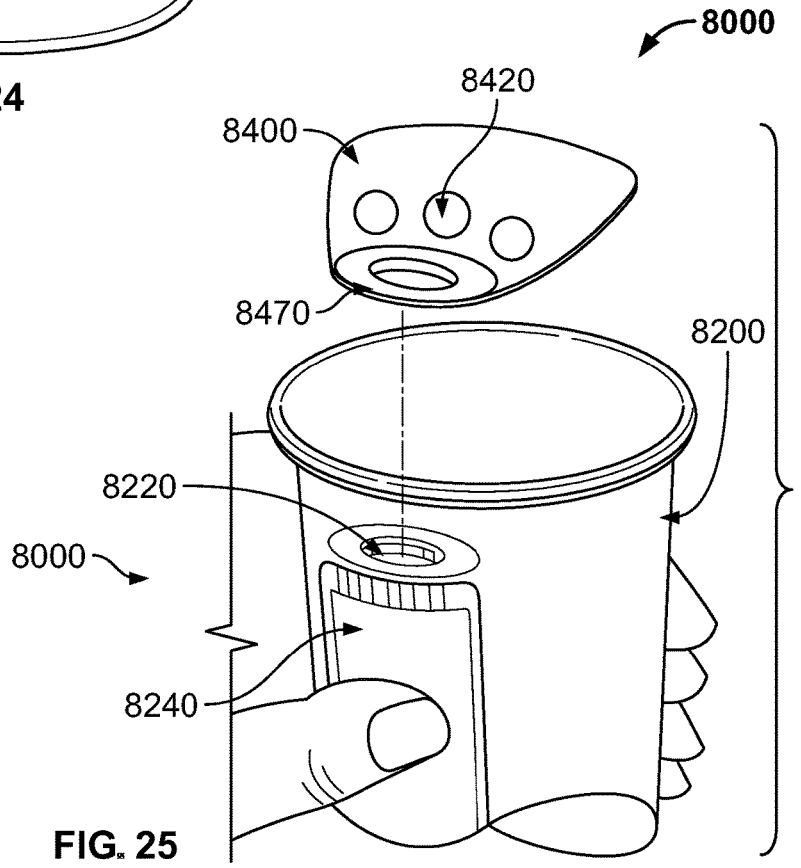
FIG. 25 is an exploded isometric view of the of the eighth embodiment of FIG. 24.

FIGS. 24-25 illustrate an eighth embodiment of the drinking cup assembly. As shown, drinking cup assembly 8000 includes drinking cup 8200 and retainer 8400. Drinking cup 8200 may be similar to the other drinking cups described herein. Retainer 8400 may be similar to the other retainers, except to the extent that retainer 8400 is described below as differing from the other retainers.

Drinking cup 8200 may include retainer attachment section 8220. Retainer attachment section 8220 may be sized, shaped, disposed, and/or oriented to connect with one or more corresponding features of retainer 8400. For example, retainer attachment section 8220 may be a recess formed during molding of drinking cup 8200. Retainer attachment section 8220 may be substantially flat, and may include a protrusion and/or depression cooperating with a corresponding depression or protrusion of retainer 8400. Drinking cup 8200 may also include a grip portion 8240, which provides a reference point for holding drinking cup 8200. For example, grip portion 8240 may be sized, shaped, oriented, and disposed to receive a thumb of the user of drinking cup 8200. Grip portion 8240 may be one or both of a recess or a protrusion. Retainer attachment section 8220 may be located at a top portion of grip portion 8240.

Retainer 8400 may include any number of openings 8420, such as, for example, one, two, three, or more opening 8420. As shown in the figures, retainer 8400 includes three openings 8420. Openings 8420 may be formed anywhere within or on retainer 8400. Openings 8420 may be the same size as, or different sizes than, one or more other openings 8420. Openings 8420 may be any shape, including but not limited to slots, circles, curves, and polygons. Openings 8420 may be distributed equally on retainer 8400, or may be distributed unequally on retainer 8400.

Retainer 8400 may include attachment section 8470, configured to attach retainer 8400 to drinking cup 8200. Attachment section 8470 may be configured to permanently or temporarily attach retainer 8400 to cup 8200. Attachment section 8470 may be substantially flat, and may include a protrusion and/or depression cooperating with a corresponding depression or protrusion of drinking cup 8200. For example, attachment section 8470 may permanently attach retainer 8400, which is intended to be disposable, to drinking cup 8200 that is intended to be disposable. Attachment section 8470 may be connected to the inner surface of cup 8200, such as retainer attachment section 8220, by achieving an interference or friction fit between retainer attachment section 8220 and attachment section 8470. Additionally or in place of the friction fit, welding, adhesive, glue, or sonic-welding may attach retainer attachment section 8220 and attachment section 8470. When retainer 8400 is folded down, at least a portion of retainer 8400 may be any shape, such as flat, or dome-shaped.

One or more of the shape or material of drinking cup 8200, retainer 8400, attachment section 8470, and/or retainer attachment section 8220 may be chosen so that drinking cups 8200 are stacked (that is, nested), when an upper drinking cup 8200 is removed from within a lower drinking cup 8200, the retainer 8400 of the lower drinking cup deploys from a configuration where it is folded against the inner wall or surface of the lower drinking cup 8200, to a configuration away from the wall of the lower drinking cup 8200, without the user having to touch or otherwise manipulate retainer 8400 into an ice-retaining position.

A method of using assembly 8000 may include attaching attachment section 8470 to cup 8200, before or after filling drinking cup 8200 with the liquid and/or ice. Retainer 8400 may be formed such that it is spring biased to a downward position—that is, from a position against the interior surface of wall of drinking cup 8200. Thus, when an upper drinking cup 8200 is removed from an interior of a lower drinking cup 8200, retainer 8400 of the lower drinking cup moves from a position against the interior wall of the lower drinking cup to an ice-retaining position, as shown in FIGS. 19 and 20.

What is claimed is:

1. A drinking cup assembly, comprising:

a drinking cup configured to retain a liquid within an interior of the drinking cup; and a retainer configured to retain ice within the interior of the drinking cup while permitting the liquid to flow from the interior of the drinking cup, wherein the retainer is configured to be permanently attached to the drinking cup, wherein the drinking cup comprises a grip portion, the grip portion comprising a recess on an exterior of the drinking cup, wherein the grip portion comprises a retainer attachment section, wherein the retainer attachment section is located at a top portion of the grip portion, wherein the retainer comprises a cup attachment section, wherein the retainer attachment section is disposed within the cup attachment section, wherein the retainer attachment section is configured to nest when the drinking cup is stacked below another drinking cup similar to the drinking cup, wherein the retainer deploys from a folded configuration against the interior of the drinking cup to an unfolded configuration away from the interior of the drinking cup.

2. The drinking cup assembly according to claim 1, wherein a connection between the retainer attachment section and the cup attachment section comprises an interference fit.

3. The drinking cup assembly according to claim 2, wherein the connection further comprises a weld.

4. The drinking cup assembly according to claim 2, wherein the connection further comprises an adhesive connection.

5. The drinking cup assembly according to claim 1, wherein a connection between the retainer attachment section and the cup attachment section comprises an adhesive connection.

6. The drinking cup assembly according to claim 1, wherein a connection between the retainer attachment section and the cup attachment section comprises a weld.

7. The drinking cup assembly according to claim 1, wherein the retainer attachment section comprises a substantially flat surface with at least one of a depression and a protrusion.

8. The drinking cup assembly according to claim 7, wherein the cup attachment section comprises at least one of a depression and a protrusion, configured to cooperatively attach to the at least one of the depression and the protrusion of the retainer attachment section.

9. The drinking cup assembly according to claim 8, wherein the retainer includes a plurality of openings configured to permit the liquid to flow through the openings and configured to retain the ice in the drinking cup.

10. The drinking cup assembly according to claim 1, wherein the retainer includes a plurality of openings configured to permit the liquid to flow through the openings and configured to retain the ice in the drinking cup.

11. The drinking cup assembly according to claim 1, wherein the cup attachment section and the retainer attachment section are configured to cooperatively attach to one another.

12. The drinking cup assembly according to claim 1, wherein the retainer is biased toward a downward position.

13. The drinking cup assembly according to claim 1, wherein the retainer includes at least one opening configured to permit the liquid to flow through the at least one opening and retain the ice in the drinking cup.

14. The drinking cup assembly according to claim 13, wherein the at least one opening comprises a plurality of openings.

15. The drinking cup assembly according to claim 1, wherein the grip portion comprises at least one of a protrusion and a recess.

16. The drinking cup assembly according to claim 1, wherein the retainer is configured to be removable from the drinking cup.

* * * * *